US011603700B2

(12) United States Patent
Davis

(10) Patent No.: US 11,603,700 B2
(45) Date of Patent: Mar. 14, 2023

(54) MOUNTING ASSEMBLY

(71) Applicant: KOHLER MIRA LIMITED, Cheltenham (GB)

(72) Inventor: Scott Antony Davis, Cheltenham (GB)

(73) Assignee: KOHLER MIRA LIMITED, Cheltenham (GB)

( * ) Notice: Subject to any disclaimer, the term of this patent is extended or adjusted under 35 U.S.C. 154(b) by 344 days.

(21) Appl. No.: 16/900,827

(22) Filed: Jun. 12, 2020

(65) Prior Publication Data

US 2020/0308897 A1 Oct. 1, 2020

Related U.S. Application Data

(63) Continuation of application No. PCT/GB2018/053573, filed on Dec. 10, 2018.

(51) Int. Cl.

| | |
|---|---|
| ***A47K 3/30*** | (2006.01) |
| ***E06B 1/60*** | (2006.01) |
| ***E06B 1/18*** | (2006.01) |

(52) U.S. Cl.

CPC ..... *E06B 1/603* (2013.01); *A47K 3/30* (2013.01); *E06B 1/18* (2013.01); *E06B 1/6076* (2013.01);

(Continued)

(58) Field of Classification Search

CPC ..... A47K 3/283; A47K 3/284; A47K 3/30; A47K 2003/305; A47K 2003/307;

(Continued)

(56) References Cited

U.S. PATENT DOCUMENTS 5,606,752 A * 3/1997 Shenton, Jr. ..... A47K 3/38 160/349.2
6,035,460 A * 3/2000 Borter ..... A47K 3/36 4/607

(Continued)

FOREIGN PATENT DOCUMENTS

| | | |
|---|---|---|
| CN | 202408670 | 9/2012 |
| DE | 41 06 116 | 9/1992 |

(Continued)

OTHER PUBLICATIONS

Combined Search and Examination Report, Great Britan Patent App. No. 1721060.0, Kohler Mira Limited (dated Jun. 11, 2018).

(Continued)

*Primary Examiner* — Kyle J. Walraed-Sullivan
(74) *Attorney, Agent, or Firm* — Husch Blackwell LLP

(57) ABSTRACT

An adjustable mounting assembly includes a wall channel; an adjustment channel fitting within the wall channel; and a connection means arranged to adjustably connect the adjustment channel to the wall channel. The connection means includes a fixing block, with a first aperture therethrough, arranged to fit within the wall channel and between the wall and adjustment channels, the first aperture arranged to receive a wall fixing member arranged to pass through the base of the wall channel so as to secure the fixing block to the wall channel; and an adjustable fixing member arranged to secure the adjustment channel to the fixing block, a head of the adjustable fixing member being within the adjustment channel in use; wherein movement of the adjustable fixing member is arranged to allow movement of the adjustment channel, and the adjustment channel is arranged to receive a profile strip to cover the adjustable fixing member.

20 Claims, 6 Drawing Sheets

(52) U.S. Cl.
CPC ..... *E06B 1/6084* (2013.01); *A47K 2003/307* (2013.01); *E05Y 2900/114* (2013.01)

(58) Field of Classification Search
CPC ..... E06B 1/10; E06B 1/18; E06B 1/20; E06B 1/6023; E06B 1/603; E06B 1/6084; E06B 1/6076; E04B 2001/2439
USPC ..... 4/614, 607, 609
See application file for complete search history.

(56) References Cited

U.S. PATENT DOCUMENTS 6,925,685 B2 * 8/2005 Chen ..... E05D 11/1064 16/241
7,380,378 B2 * 6/2008 Clifford ..... E06B 3/549 52/204.72
8,925,258 B1 * 1/2015 Header ..... E06B 3/70 52/767
2013/0025232 A1 * 1/2013 Wang ..... A47K 3/34 52/656.4
2014/0115773 A1 * 5/2014 Wei ..... A47K 3/30 4/607
2014/0237715 A1 * 8/2014 Wei ..... A47K 3/34 4/607
2014/0237903 A1 * 8/2014 Wei ..... A47K 3/30 49/504
2014/0250584 A1 * 9/2014 Wei ..... A47K 3/30 4/607
2014/0250795 A1 * 9/2014 Wei ..... A47K 3/36 49/505
2015/0033635 A1 * 2/2015 Wei ..... A47K 3/30 49/505
2015/0096258 A1 * 4/2015 Wei ..... E06B 3/06 52/656.4
2015/0272397 A1 * 10/2015 Wei ..... E05D 11/0054 4/614
2017/0245696 A1 * 8/2017 Minkovich ..... F16B 5/0685
2017/0360262 A1 * 12/2017 Wei ..... F16B 5/0628
2018/0163400 A1 * 6/2018 Mei ..... E04B 2/7416
2018/0344098 A1 * 12/2018 Lieb ..... E05D 5/14

FOREIGN PATENT DOCUMENTS

EP 0 441 010 8/1991
EP 2676587 A2 * 12/2013 ..... A47K 3/30
EP 3011881 A1 * 4/2016 ..... A47K 3/30
GB 2 504 661 2/2014

OTHER PUBLICATIONS

International Search Report and Written Opinion, PCT/GB2018/053573, Kohler Mira Limited (dated Feb. 22, 2019).

* cited by examiner

MOUNTING ASSEMBLY

CROSS-REFERENCE TO RELATED PATENT APPLICATIONS

This application is a Continuation of International Application No. PCT/GB2018/053573, filed Dec. 10, 2018, which claims the benefit of and priority to United Kingdom Priority Application No. GB 1721060.0, filed Dec. 15, 2017. The entire disclosures of the aforementioned applications, including their specifications, drawings, claims and abstracts, are incorporated herein by reference in their entireties.

BACKGROUND

The present application relates to a mounting assembly suitable for use with a shower enclosure, and more particularly to an adjustable mounting assembly arranged to allow a profile strip to be mounted on, and transversely adjustable with respect to, a wall channel.

In the prior art, wall channels for use with shower enclosures are known. In particular, a wall channel, which is often at least substantially U-shaped in cross-section, can be secured to a wall or other support and used to hold a panel (which may be clamped within the channel), a profile strip extending along the length of the wall channel, or the likes. Profile strips are used to adjust frame width and to improve aesthetics. For example, a profile strip may be moved transversely away from the wall channel to ensure that a door meets the profile strip when closed. Profile strips may also act as a cover or seal for the wall channel.

In the prior art, a screw through the side of the wall channel is often used to secure the profile strip, or a mount for the profile strip within the wall channel, once it has been moved into a desired position by adjustment perpendicular to the length of the wall channel. A cover is then provided to cover the head of the screw, which is outside of the wall channel.

In DE 41 06 116 A1, a telescopic arrangement of coaxial screws is used. The screws are arranged to lie within the wall channel in use, such that the profile strip itself covers the head of the screw. However, adjustment of this arrangement, in particular with respect to how the wall channel is secured to the wall, is not easy.

It would be advantageous to provide an improved mounting assembly suitable for use with a shower enclosure that addresses one or more of these or other issues as will be apparent to those reviewing the present disclosure.

SUMMARY

According to an exemplary embodiment, an adjustable mounting assembly includes a wall channel arranged to be fixedly connected to a wall, the wall channel having a base. The adjustable mounting assembly also includes an adjustment channel arranged to fit at least partially within the wall channel, and further includes a connection means arranged to connect the wall channel to the wall and to adjustably connect the adjustment channel to the wall channel such that the adjustment channel can be moved towards and away from the base of the wall channel. The connection means includes a fixing block arranged to fit within the wall channel and between the wall channel and the adjustment channel, the fixing block having a first aperture therethrough, wherein the first aperture is arranged to receive a wall fixing member, the wall fixing member being arranged to pass through the base of the wall channel so as to secure the fixing block to the wall channel and the wall channel to the wall. The connection means also includes an adjustable fixing member arranged to pass through the adjustment channel and into the fixing block, so as to secure the adjustment channel to the fixing block, a head of the adjustable fixing member being within the adjustment channel when in use. Movement of the adjustable fixing member is arranged to provide the movement of the adjustment channel towards and away from the base of the wall channel, and the adjustment channel is arranged to receive a profile strip to cover the wall fixing member and the adjustable fixing member, and wherein the adjustment channel has a first aperture arranged to allow the wall fixing member to pass therethrough and suitable for allowing the wall fixing member to be tightened therethrough.

According to another exemplary embodiment, a kit of parts for an adjustable mounting assembly includes a wall channel arranged to be fixedly connected to a wall, the wall channel having a base and an adjustment channel arranged to fit at least partially within the wall channel. The kit also includes a connection means arranged to connect the wall channel to the wall and to adjustably connect the adjustment channel to the wall channel such that the adjustment channel can be moved towards and away from the base of the wall channel. The connection means includes a fixing block arranged to fit within the wall channel and between the wall channel and the adjustment channel. The connection means also includes a wall fixing member arranged to pass through the base of the wall channel so as to secure the fixing block to the wall channel and the wall channel to the wall. The connection means further includes an adjustable fixing member arranged to pass through the adjustment channel and into the fixing block, so as to secure the adjustment channel to the fixing block, a head of the adjustable fixing member being within the adjustment channel when in use. Movement of the adjustable fixing member is arranged to provide the movement of the adjustment channel towards and away from the base of the wall channel, and the adjustment channel is arranged to receive a profile strip to cover the wall fixing member and the adjustable fixing member, and wherein the adjustment channel has a first aperture arranged to allow the wall fixing member to pass therethrough and suitable for allowing the wall fixing member to be tightened therethrough.

According to another exemplary embodiment, a shower cubicle includes an adjustable mounting assembly that includes a wall channel arranged to be fixedly connected to a wall, the wall channel having a base. The adjustable mounting assembly also includes an adjustment channel arranged to fit at least partially within the wall channel, and further includes a connection means arranged to connect the wall channel to the wall and to adjustably connect the adjustment channel to the wall channel such that the adjustment channel can be moved towards and away from the base of the wall channel. The connection means includes a fixing block arranged to fit within the wall channel and between the wall channel and the adjustment channel, the fixing block having a first aperture therethrough, wherein the first aperture is arranged to receive a wall fixing member, the wall fixing member being arranged to pass through the base of the wall channel so as to secure the fixing block to the wall channel and the wall channel to the wall. The connection means also includes an adjustable fixing member arranged to pass through the adjustment channel and into the fixing block, so as to secure the adjustment channel to the fixing block, a head of the adjustable fixing member being within the adjustment channel when in use. Movement of the adjustable fixing member is arranged to provide the movement of the adjustment channel towards and away from the base of the wall channel, and the adjustment channel is arranged to receive a profile strip to cover the wall fixing member and the adjustable fixing member, and wherein the adjustment channel has a first aperture arranged to allow the wall fixing member to pass therethrough and suitable for allowing the wall fixing member to be tightened therethrough.

BRIEF DESCRIPTION OF THE DRAWINGS

There now follows by way of example only a detailed description of embodiments with reference to the accompanying drawings in which.

DETAILED DESCRIPTION

Figure 1:
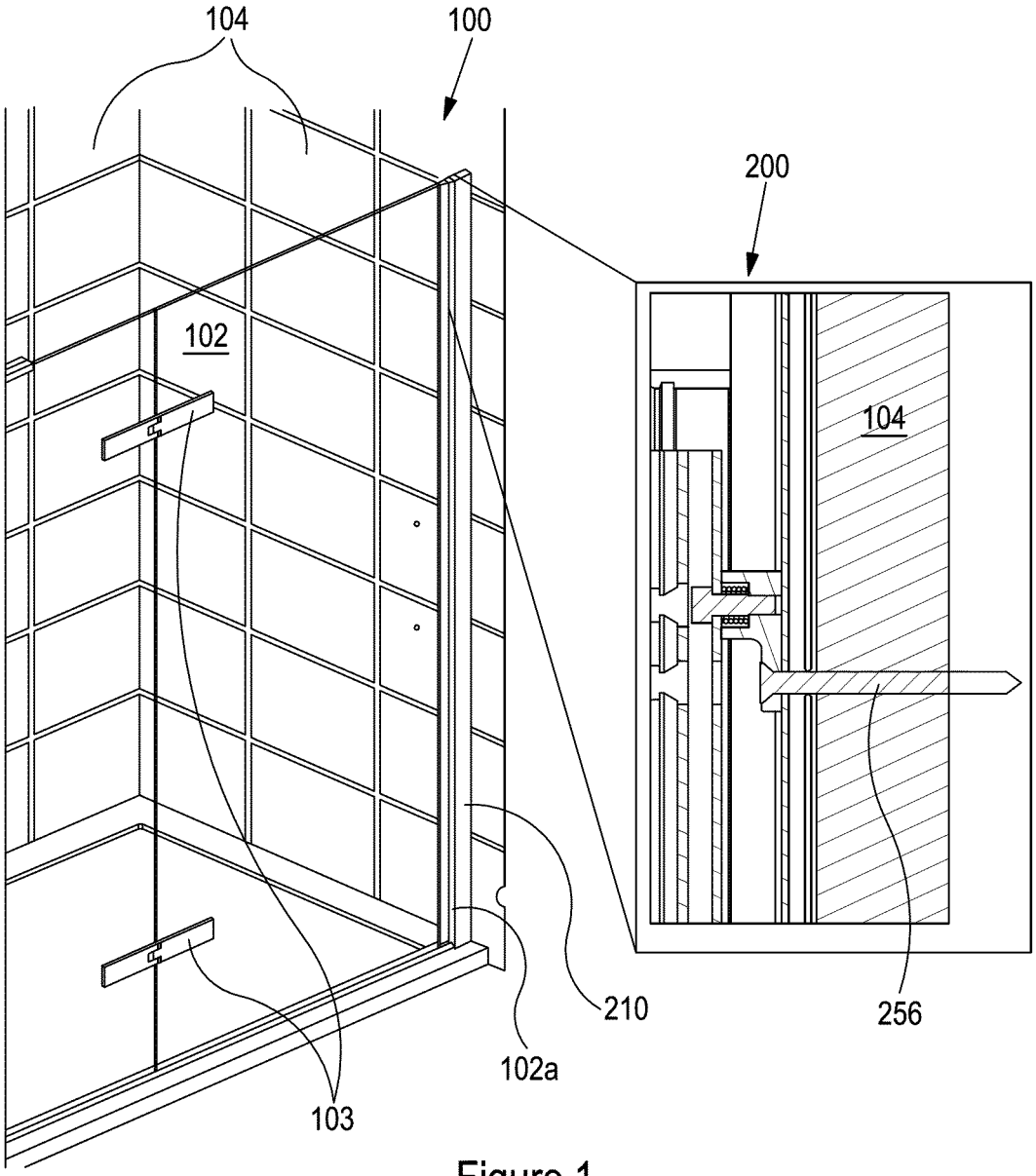
FIG. 1 shows a shower cubicle incorporating a mounting assembly of an embodiment of the invention.

According to a first aspect of the invention, there is provided an adjustable mounting assembly that includes a wall channel arranged to be fixedly connected to a wall, the wall channel having a base; an adjustment channel arranged to fit at least partially within the wall channel; and a connection means arranged to adjustably connect the adjustment channel to the wall channel such that the adjustment channel can be moved towards and away from the base of the wall channel.

The connection means includes a fixing block arranged to fit within the wall channel and between the wall channel and the adjustment channel, the fixing block having a first aperture therethrough, wherein the first aperture is arranged to receive a wall fixing member, the wall fixing member being arranged to pass through the base of the wall channel so as to secure the fixing block to the wall channel. The connection means also includes an adjustable fixing member arranged to pass through the adjustment channel and into the fixing block, so as to secure the adjustment channel to the fixing block, a head of the adjustable fixing member being within the adjustment channel in use.

Movement of the adjustable fixing member is arranged to provide the movement of the adjustment channel towards and away from the base of the wall channel, and the adjustment channel is arranged to receive a profile strip to cover the adjustable fixing member.

Advantageously, as the wall fixing means passes through the fixing block, it may be used to secure the fixing block in place before the adjustment channel is inserted.

The adjustable fixing member may be or comprise a screw and optionally the movement of the adjustable fixing member may be rotation of the screw.

The adjustable fixing member may be arranged to be oriented at least substantially perpendicular to the length of the adjustment channel in use.

The connection means may be arranged to connect the wall channel to a wall.

The wall fixing member may additionally connect the wall channel to the wall.

The profile strip may cover the wall fixing member.

The adjustable fixing member may comprise a biasing member arranged to exert a force, the force optionally being on the adjustment channel and arranged so as to hold, or to assist in holding, the adjustment channel against a head of the adjustable fixing member.

In embodiments with a biasing member, the biasing member may be an adjustment spring, optionally arranged around a shaft of the adjustable fixing member.

The adjustable mounting assembly may further comprise the profile strip.

The profile strip may be at least one of push-fit and magnetic.

The fixing block may have a second aperture spaced from the first aperture.

The second aperture may be arranged to receive the adjustable fixing member.

The second aperture may be blind.

In embodiments with a biasing member, the second aperture may be wider nearest its opening so as to accommodate the biasing member in the region of its opening.

The width of the second aperture in such embodiments may be stepped from a wider portion to a narrower portion, and the biasing means may be arranged to be retained within the wider portion by the step in width.

The fixing block may be substantially L-shaped in cross-section.

In embodiments with a second aperture, the second aperture may be sized such that at least the majority of the length of the adjustable fixing member can be accommodated within the second aperture.

The fixing block may be wider in vicinity of the second aperture such that at least a portion of a shaft of an adjustment screw can be accommodated within the second aperture.

The adjustment channel may have a first aperture arranged to allow the wall fixing member to pass therethrough. The first aperture may be arranged to allow the wall fixing member to be tightened therethrough.

The wall fixing member may be a wall screw.

The first aperture of the adjustment channel may be wide enough for a head of the wall screw to pass therethrough.

The adjustment channel may have a second aperture arranged to allow a shaft of the adjustable fixing member to be inserted therethrough, the second aperture of the adjustment channel being too narrow for a head of the adjustable fixing member to pass therethrough.

The second aperture of the adjustment channel may be through the wall of the closed channel furthest from the open channel.

The adjustment channel may comprise a third aperture. The third aperture may be through the wall of the closed channel which forms the base of the open channel and may be aligned with the second aperture.

The third aperture may be wide enough for a head of the adjustable fixing member, and the biasing member (where present), to pass therethrough.

The third aperture may be arranged to allow the adjustable fixing member to be adjusted therethrough.

The adjustment channel may be shaped such that a head of the adjustable fixing member is retained within the closed channel in use.

The open channel may be arranged to receive the profile strip in use.

According to a second aspect of the invention, there is provided a kit of parts for an adjustable mounting assembly, the kit of parts that includes a wall channel arranged to be fixedly connected to a wall, the wall channel having a base; an adjustment channel arranged to fit at least partially within the wall channel; and a connection means arranged to adjustably connect the adjustment channel to the wall channel such that the adjustment channel can be moved towards and away from the base of the wall channel.

The connection means includes a fixing block arranged to fit within the wall channel and between the wall channel and the adjustment channel; a wall fixing member arranged to pass through the base of the wall channel so as to secure the fixing block to the wall channel; and an adjustable fixing member arranged to pass through the adjustment channel and into the fixing block, so as to secure the adjustment channel to the fixing block, a head of the adjustable fixing member being within the adjustment channel in use.

Movement of the adjustable fixing member is arranged to provide the movement of the adjustment channel towards and away from the base of the wall channel, and the adjustment channel is arranged to receive a profile strip to cover the adjustable fixing member.

The wall fixing member may be a wall screw.

The wall fixing member may be arranged to be at least substantially perpendicular to the length of the wall channel in use.

According to a third aspect of the invention, there is provided a shower cubicle comprising at least one adjustable mounting assembly according to the first aspect of the invention.

The shower cubicle may further comprise the profile strip.

The shower cubicle may further comprise a door.

Optionally, the edge of the door furthest from its hinge is arranged to make contact with the profile strip when the door is closed.

According to a fourth aspect of the invention, there is provided a kit of parts for making a shower cubicle, the kit of parts comprising at least one adjustable mounting assembly according to the first aspect of the invention and one or more panels, wherein one of the one or more panels is arranged to form a door.

The skilled person would understand that features described with respect to one aspect of the invention may be applied, mutatis mutandis, to the other aspect of the invention.

Turning now to the accompanying drawings, FIG. 1 shows a shower enclosure 100 door 102, hinge 103, door edge 102*a* furthest from the hinge, walls 104 and shower tray 106.

A wall channel 210 is mounted on the wall 104.

The wall channel 210 is part of an adjustable mounting assembly 200 which is secured to the wall 104.

Figure 2:
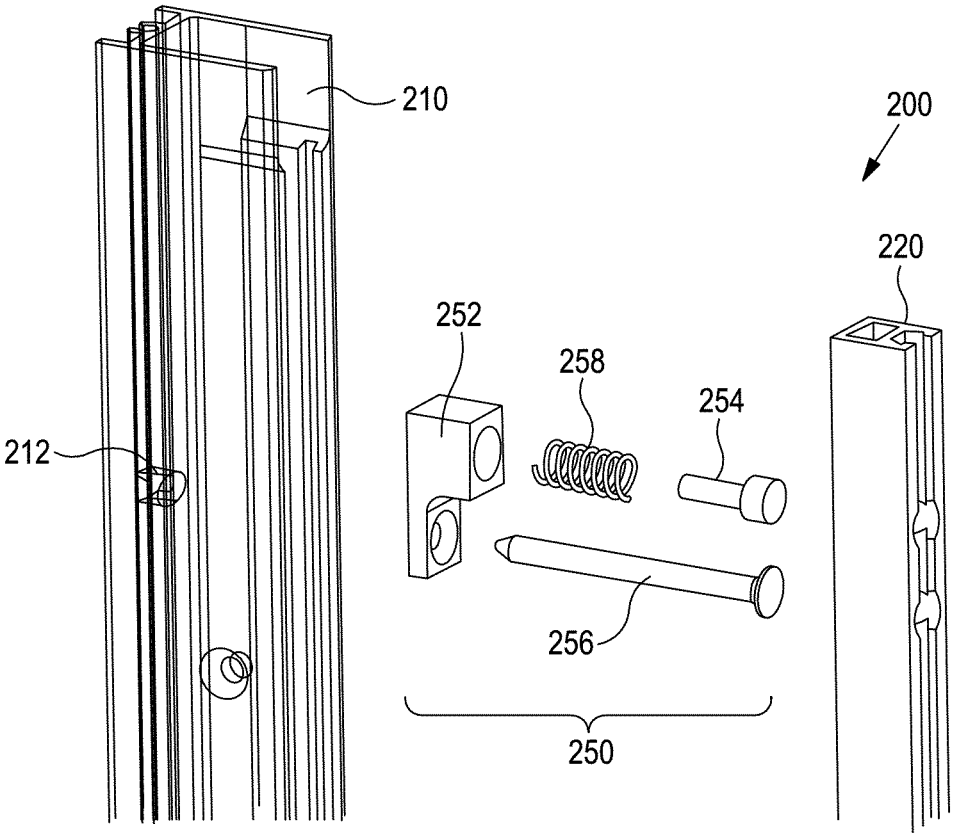
FIG. 2 shows an exploded view of a mounting assembly of an embodiment of the invention.
Figure 3:
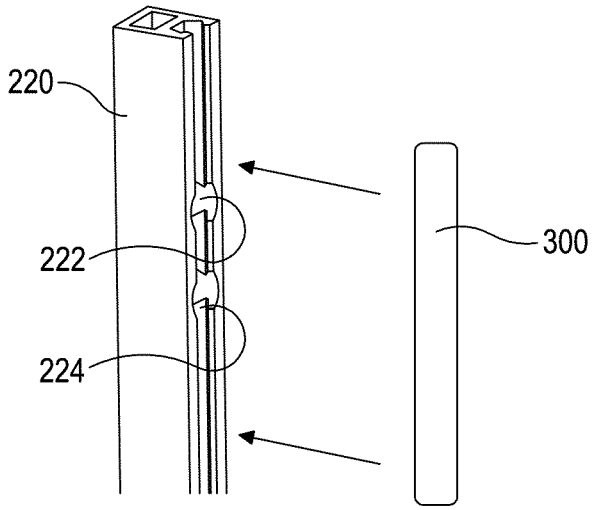
FIG. 3 shows the adjustment channel of FIG. 2 with a profile strip.
Figure 4:
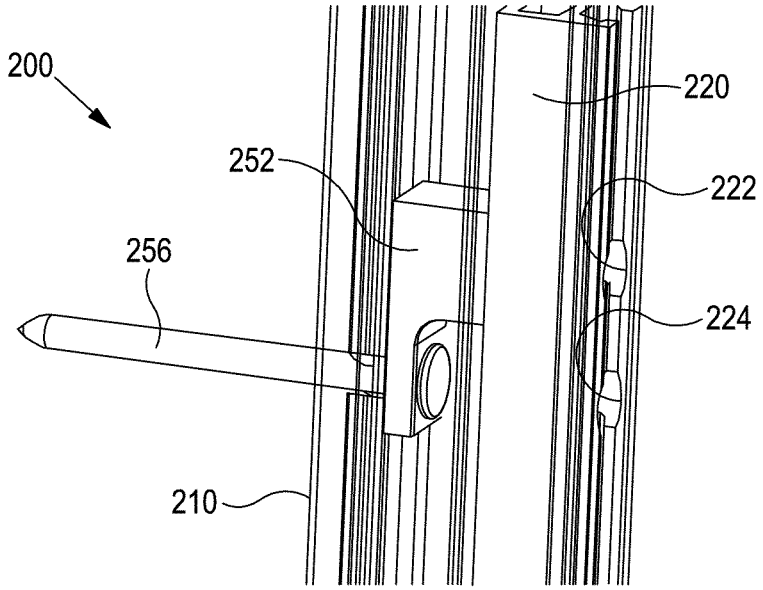
FIG. 4 shows a perspective view of the mounting assembly of FIG. 2 in an assembled configuration, with the wall channel shown as translucent.
Figure 5A:
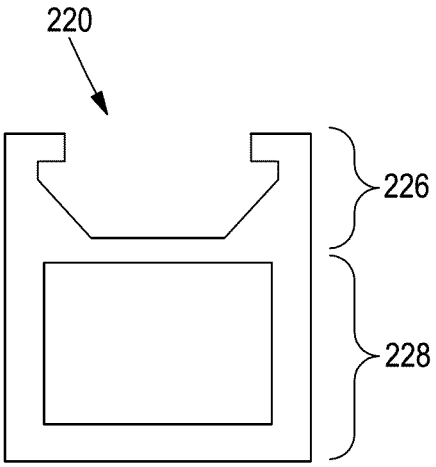
FIGS. 5A and 5B show cross-sectional views of the adjustment channel shown in FIGS. 2 to 4.
Figure 5B:
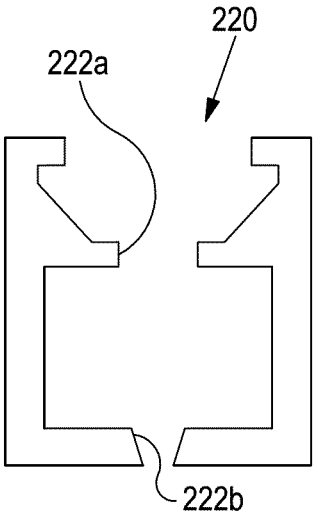
Figure 6A:
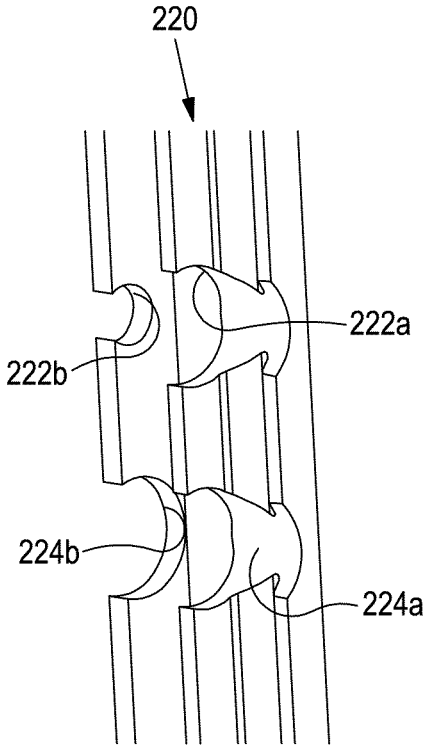
FIG. 6A shows a cut-away view of the adjustment channel shown in the preceding figures.
Figure 6B:
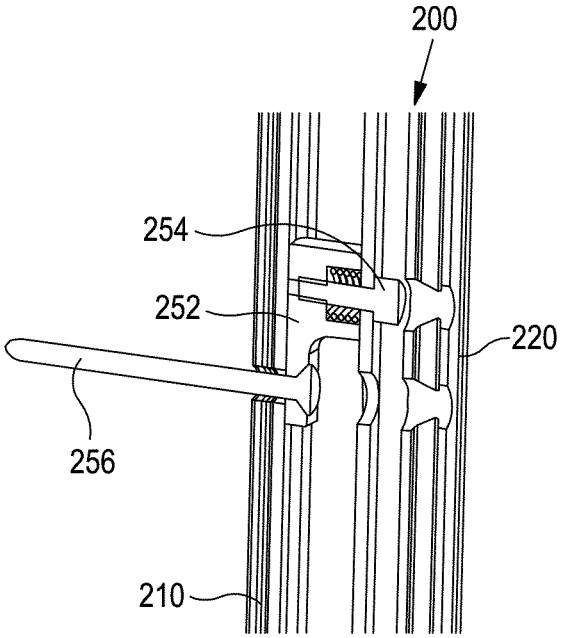
FIG. 6B shows a cross-sectional view of the mounting assembly of FIG. 2.
Figure 7:
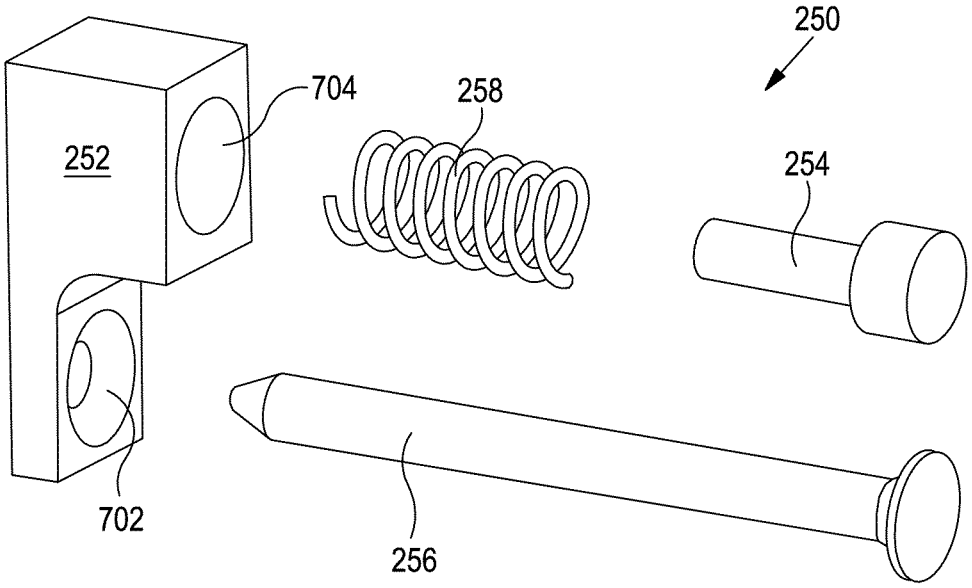
FIG. 7 shows an exploded view of the connection means shown in FIGS. 2 and 4.

The adjustable mounting assembly 200 is shown in more detail in FIG. 2.

The adjustable mounting assembly 200 comprises a wall channel 210. The wall channel 210 is substantially U-shaped in cross-section. The base of the U-shaped wall channel 210 is arranged, in use, to lie against a wall 104 or other support.

An aperture 212 is provided in the base of the U-shaped wall channel 210.

The adjustable mounting assembly 200 comprises a wall screw 256. In the embodiment being described, the wall screw 256 is a sharp, self-tapping screw to facilitate insertion into a wall or other support. The skilled person will appreciate that other kinds of screws could be used.

The aperture 212 in the base of the U-shaped wall channel 210 is arranged to receive the wall screw 256, so as to secure the wall channel 210 to the wall or other support. The skilled person will appreciate that multiple apertures 212 may be provided in some embodiments, and that additional fastening means, such as adhesive or the likes, may be used in some embodiments.

The prongs of the U-shaped wall channel 210 are arranged to extend away from the wall or other support to which the wall channel 210 is connected.

The wall channel 210 is arranged to run vertically along the wall 104 or other support for the full height of the door 102. The edge 102*a* of the door 102 is adjacent to the wall channel 210 when the door 102 is closed.

The adjustable mounting assembly 200 comprises an adjustment channel 220. The adjustment channel 220 is arranged to fit at least partially within the wall channel 210. In the embodiment shown, the adjustment channel 220 fits entirely within the wall channel 210. In use, the adjustment channel 220 is parallel to the wall channel 210.

In the embodiment being described, the adjustment channel 220 comprises a tube portion 228 running parallel to, and integral with, an open channel portion 226. The tube portion 228 has a rectangular cross-section in the embodiment being described. The rectangular tube portion 228 is closer to the base of the U-shaped wall channel 210 than the open channel 226 is, in the embodiment being described.

In the embodiment being described, the outer edge of the open channel 226 of the adjustment channel 220 lies flush with the outer edge of the prongs of the U-shaped wall channel 210.

In the embodiment being described, the open channel 226 is shaped to receive a profile strip 300. In this embodiment, the profile strip 300 is a push-fit with the open channel 226.

In this embodiment, the adjustment channel 220 is made of metal and the profile strip 300 is magnetic so as to further improve grip, whilst still allowing the profile strip 300 to be removable.

In alternative embodiments, the profile strip 300 may be only one of (i) push-fit and (ii) magnetic. In alternative or additional embodiments, alternative or additional fastening means and/or an adhesive may be used to attach the profile strip 300 to the adjustment channel 220.

In the embodiment being described, the adjustment channel 220 has two apertures 222, 224 therethrough.

In the embodiment being described, each aperture 222, 224 passes through two opposing faces of the tube portion 228 and opens into the open channel 226, and so may be thought of as comprising two separate apertures.

The first aperture 224 is the same size in both opposing faces of the tube portion 228 in the embodiment being described. The first aperture 224 is sized to allow the wall screw 256 to pass through the aperture 224, such that the head of the wall screw 256, not just its shaft, can pass therethrough. The first aperture 224 is sized to allow the wall screw 256 to be tightened by insertion of a screwdriver therethrough.

The adjustable mounting assembly 200 comprises an adjustment screw 254. In the embodiment being described, the adjustment screw 254 has a flat tip and does not taper (the shaft has a constant cross-section), as the screw is not intended to penetrate a surface but instead to mesh with the internal wall of a cylindrical aperture as described below. The skilled person will appreciate that other types of screw may be used in other embodiments.

The second aperture 222 is wider at the base of the open channel 226 (aperture 222*a*) than it is passing through the opposing wall of the tube portion 228 (aperture 222*b*). The second aperture 222 is sized to allow the shaft of the adjustment screw 254 to pass through both opposing faces of the tube portion 228, but the head of the adjustment screw 254 only to pass through the aperture 222*a* in the face of the tube portion 228 which forms the base of the open channel 226. The head of the adjustment screw 254 is therefore retained within the tube portion 228 such that the screw can be used to attach the adjustment channel 220 to a fixing block 252 (described below) without the head protruding into the open channel 226.

The aperture 222*b* is countersunk to accommodate the head of the adjustment screw 254 in the embodiment being described. In alternative embodiments, the aperture 222*b* may not be countersunk.

In alternative or additional embodiments, the adjustment channel 220 may have more apertures, and/or may not have a separate tube portion 228. In embodiments without a separate tube portion, the aperture 222*a* at the base of the channel is preferably narrow enough to prevent the head of the adjustment screw 254 passing therethrough. Preferably in such embodiments the aperture 222*a* is countersunk to accommodate the head of the adjustment screw 254 so as to reduce the chance of the screw head interfering with a profile strip 300 arranged to be inserted into the open channel 226.

The adjustable mounting assembly 200 comprises a fixing block 252. The fixing block 252 is sized to fit within the wall channel 210, and between the base of the U-shaped wall channel 210 and the adjustment channel 220.

The fixing block 252 has a first aperture 702 therethrough arranged to allow the shaft of the wall screw 256, but not the head of the wall screw 256, to pass therethrough.

In the embodiment being described, the first aperture 702 of the fixing block 252 is countersunk to accommodate the head of the wall screw 256.

The fixing block 252 has a second aperture 704 therethrough, arranged to receive the shaft of the adjustment screw 254. In the embodiment being described, the second aperture 704 comprises two portions 704*a*, 704*b* of different widths.

The first portion 704*a*, arranged in use to be nearest to the head of the adjustment screw 254 (and so nearest to the adjustment channel 220 in which the head of the adjustment screw is retained) is wider than the shaft of the adjustment screw 254. In the embodiment being described, the first portion 704*a* is at least substantially cylindrical.

The second portion 704*b*, arranged in use to be nearest to the tip of the adjustment screw 254 (and so nearest to the base of the wall channel 210), is narrower than the first portion 704*a* and sized to engage the shaft of the adjustment screw 254.

In the embodiment being described, the inner surface of the second portion 704*b* is threaded, the thread being sized to mesh with the thread of the adjustment screw 254. In alternative embodiments, the second portion 704*b* of the aperture may not be threaded, and may instead be slightly narrower than the adjustment screw 254 and made of or lined with a material sufficiently soft for the screw to bite into without being soft enough for the screw to pull through or out, e.g. wood or a hard plastic. In alternative embodiments, the second aperture 704 of the fixing block 252 may not be present, and the fixing block may instead be made of or comprise a portion of a material sufficiently soft for the screw to bite into without being soft enough for the screw to pull through or out, e.g. wood or a hard plastic.

In the embodiment being described, the second aperture 704 passes all the way through the fixing block 252. The end of the aperture 704 furthest from the adjustment screw head is blocked by the base of the wall channel 210, against which the fixing block 252 rests.

In alternative embodiments, the second aperture 704 may not pass all the way through the fixing block, and may instead be blind.

Figure 8:
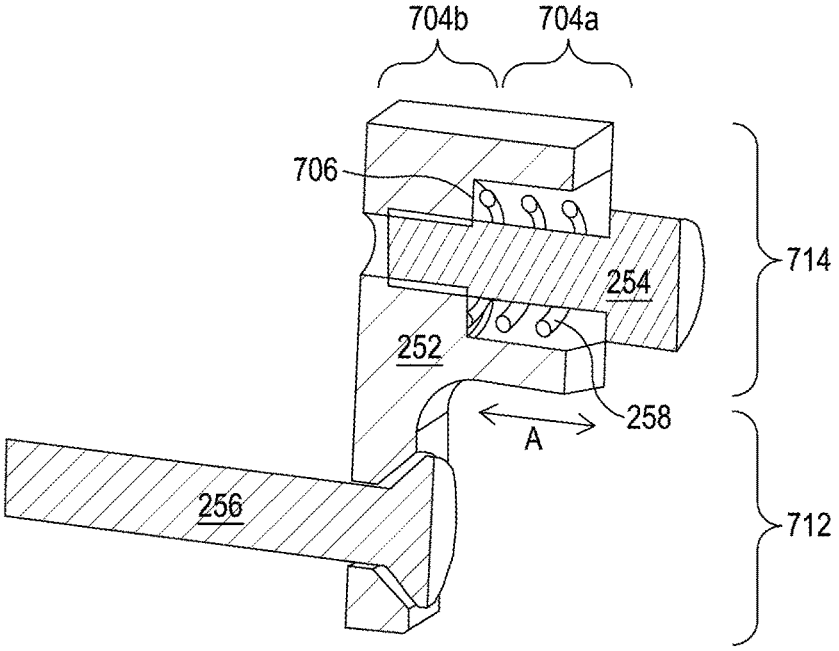
FIG. 8 shows a cross-sectional view of the connection means shown in FIG. 7 in an assembled configuration.

In the embodiment being described, the first portion 704*a* is sized to contain a spring 258 wound around the portion of the shaft of the adjustment screw 254 within the first portion 704*a* of the aperture 704. In use, the spring 254 is compressed within the first portion 704*a* of the aperture 704, and so exerts an outward force between the step 706 between the first and second portions 704*a*, 704*b* of the aperture 704 and the adjustment channel 720 (as indicated by arrow A in FIG. 8). The spring 258 therefore assists in holding the base of the adjustment channel 220 against the head of the adjustment screw 254. The skilled person will appreciate that different or additional biasing members may be used instead of or as well as one or more springs.

The fixing block 252, screws 254, 256 and spring 258 are collectively referred to as a connection means 250.

In alternative or additional embodiments, multiple springs 258 may be used, and/or the springs may be located adjacent to the adjustment screw 254 instead of wound around it.

In alternative embodiments, a spring 258 may not be used. In such embodiments, the second aperture 704 of the fixing block 252 may have a constant width instead of having first and second portions 704*a*, 704*b* of different widths.

In alternative or additional embodiments, one or more further cavities may be provided in the fixing block 252, each cavity containing a biasing member such as a spring.

In the embodiment being described, the fixing block 252 is widest in the region 714 of the second aperture 704; the width of the fixing block 252 is selected to accommodate at least substantially the full length of the shaft of the adjustment screw. Advantageously, the width allows for adjustment of the spacing between the wall channel 210 and the adjustment channel 220 by rotation of the adjustment screw 254, from a minimum spacing of the width of the fixing block to a maximum spacing of the width of the fixing block plus a portion of the shaft length of the adjustment screw 254. In the embodiment being described, the spring 258 is selected to keep the adjustment channel 220 pressed against the adjustment screw head even when the channels are at their maximum spacing.

In the embodiment being described, the fixing block 252 is narrowest in the region 712 of the first aperture 702. The width of the narrowest region 712 is selected to provide sufficient rigidity and strength of the fixing block 252 whilst allowing the majority of the length of the shaft of the wall screw 256 to protrude so that the wall screw 256 can be firmly anchored into a wall.

Figure 9:
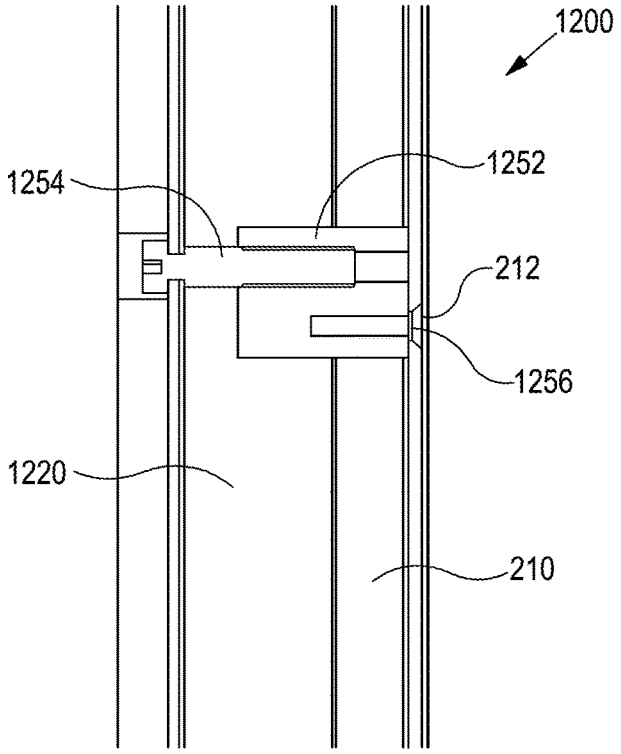
FIG. 9 shows a cross-sectional view of a mounting assembly of another embodiment of the invention.
Figure 10:
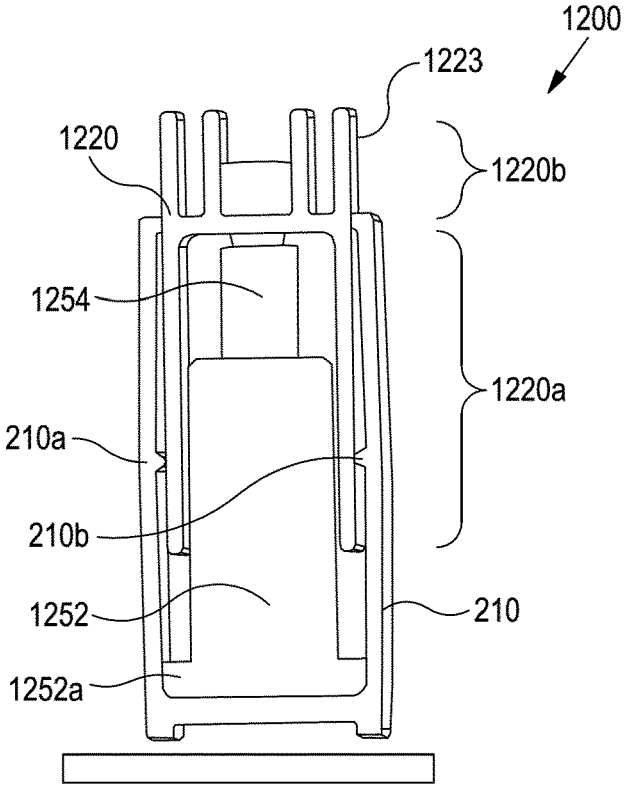
FIG. 10 shows a side view of the mounting assembly shown in FIG. 9.
Figure 11:
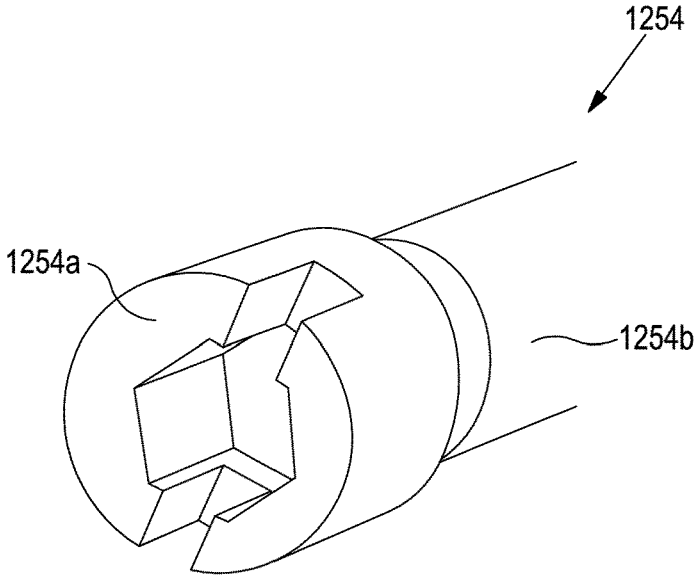
FIG. 11 shows the head of the adjustment screw of the mounting assembly shown in FIGS. 9 and 10.

An alternative embodiment is shown in FIGS. 9, 10 and 11.

In the embodiment shown in FIGS. 9, 10 and 11, the adjustable mounting assembly 1200 comprises a wall channel 210. The wall channel 210 is substantially U-shaped in cross-section. The base of the U-shaped wall channel 210 is arranged, in use, to lie against a wall or other support. In the embodiment being described, the wall channel 210 is equivalent to that of the embodiment shown in FIGS. 1 to 8.

An aperture 212 is provided in the base of the U-shaped wall channel 210.

The adjustable mounting assembly 1200 comprises an adjustment channel 1220. The adjustment channel 1220 is arranged to fit at least partially within the wall channel 210. In the embodiment shown, a first U-shaped portion 1220*a* of the adjustment channel 1220 fits entirely within the U-shaped portion of the wall channel 210. In use, the adjustment channel 1220 is parallel to the wall channel 210. A second U-shaped portion 1220*b* of the adjustment channel 1220 extends in the opposite direction from the first-shaped portion 1220*a*, with a common base. In the embodiment being described, the second U-shaped portion 1220*b* is narrower and shorter than the first.

The adjustable mounting assembly 1200 comprises an adjustment screw 1254. In the embodiment being described, the adjustment screw 1254 has a flat tip and does not taper (the shaft has a constant cross-section), as the screw is not intended to penetrate a surface but instead to mesh with the internal wall of a cylindrical aperture as described below. The skilled person will appreciate that other types of screw may be used in other embodiments.

In the embodiment being described, the adjustment screw 1254 passes through the first and second U-shaped portions 1220*a,b* of the adjustment channel 1220. The shaft of the adjustment screw 1254 passes through an aperture in the base of the second U-shaped portion 1220*b* such that it extends into the first U-shaped portion 1220*a*.

In the embodiment being described, there is a groove in shaft of the adjustment screw 1254 as shown in FIG. 9. The groove is arranged so as to keep the head of the screw 1254 in a set position. The aperture in the adjustment channel 1220 is sized such that the shaft of the screw could not pass through the aperture, so holding the head in place—the groove in the shaft is not much longer than the width of the base of the adjustment channel 1220, so allowing rotational movement of the screw but limiting any lateral displacement. In other embodiments, there may be no such groove in the adjustment screw 1254, or a groove may be differently sized or shaped.

In the embodiment shown in FIG. 9, the connection to the wall not shown. In this embodiment, the location screw 1256 cannot be accessed once the wall channel 210 is secured to a wall. In alternative embodiments, the adjustable mounting assembly may be arranged differently such that the location screw can still be accessed once mounted, as for the embodiment shown in FIG. 8.

In the embodiment being described, the head 1254*a* of the adjustment screw 1254 is wider than the aperture and is therefore retained within the second U-shaped portion 1220*b* such that the screw can be used to attach the adjustment channel 1220 to a fixing block 1252 (described below) without the head 1254*a* protruding beyond the adjustment channel 1220.

In the embodiment being described, the second U-shaped portion 1220*b* is shaped to receive a profile strip 300. In this embodiment, the profile strip 300 is a push-fit with the second U-shaped portion 1220*b*.

In the embodiment shown in FIG. 10, the second U-shaped portion 1220*b* is double-walled in that two parallel walls for each "leg" of the U-shape, with the head 1254*a* of the adjustment screw 1254 lying between the innermost walls.

In the embodiment being described, the double-walled second U-shaped portion 1220*b* is shaped and sized to engagingly receive the profile strip 300, which can be thought of as a seal for the assembly. The skilled person will appreciate that the double walled design shown is simply one possible example for an engaging fit and that, even in embodiments in which an engaging fit is provided, the shape of this portion may be different. In still further embodiments, a seal or profile strip 300 may be connected without an engaging fit; for example using a fastener or adhesive.

The adjustable mounting assembly 1200 comprises a fixing block 1252.

The fixing block 1252 comprises a channel arranged to receive the shaft 1254*b* of the adjustment screw 1254. In the embodiment being described, the shaft 1254*b* and the channel are both threaded, so as to allow inter-engagement.

In the embodiment being described, the fixing block 1252 is substantially cuboid in shape, with a lip 1252*a* at the end arranged to lie against the base of the wall channel 210.

In the embodiment being described, the lip 1252*a* is arranged to have a width to match that of the U-shaped portion of the wall channel 210, such that the fixing block 1252 fits snugly within the wall channel and cannot substantially move transverse to the wall channel. The skilled person will appreciate that this may aid the alignment of apertures and screws.

In the embodiment being described, the rest of the fixing block 1252 is narrower than the lip. Advantageously, this may allow the walls of the adjustment channel 1220 to lie between the walls of the wall channel 210 and the fixing block 1252 whilst still maintaining a snug fit at the base of the wall channel 210. The lips 1252*a* have a similar width to the walls of the adjustment channel 1220 in some embodiments, so as to provide a snug fit.

In the embodiment being described, the fixing block 1252 is made of plastic. The skilled person would appreciate that other materials, such as wood or metal, or a combination of materials, may be used in some embodiments.

In the embodiment being described, the fixing block 1252 is made by machining.

In the embodiment being described, the fixing block 1252 is located within the wall channel 210.

The fixing block 1252 is mounted between the base of the wall channel 210 and the base of the adjustment channel 1220.

In the embodiment being described, two ridges 210*a*, 210*b* are provided along the inner surfaces of the walls of the wall channel 210. In the embodiment being described, the two ridges 210*a*, 210*b* are parallel to and level with each other, and parallel to the length of the wall channel 210. In this embodiment, the two ridges 210*a*, 210*b* act as rest points for the adjustment channel 1220 to move in and out of the wall channel 210. In alternative or additional embodiments, more or fewer ridges 201*a,b* may be provided, and/or discontinuous pips or bumps may be used instead of or as well as ridges along the length of the wall channel 210. Further, in some embodiments, the rest points 210*a*, 210*b* may be provided on outer walls of the adjustment channel 1220 instead of inner walls of the wall channel 210.

In the embodiment being described, the fixing block 1252 is located partially within the adjustment channel 1220, extending put of the first U-shaped portion 1220*a* thereof.

In the embodiment being described, the fixing block 1252 is mounted in place using a location screw 1256. The location screw 1256 extends through an aperture 212 in the base of the wall channel 210 and into the fixing block 1252, so holding the fixing block 1252 in place within the wall channel. The location screw 1256 extends into a second channel within the fixing block 1252. The channels within the fixing block 1252 may extend all the way therethrough or be blind.

The adjustment screw 1254 can then be inserted through the aperture in the adjustment channel 1220 and into the fixing block 1252.

The skilled person will appreciate that, by turning the adjustment screw 1254, the adjustment channel 1220 can be moved further into/out of the wall channel 210.

The skilled person will appreciate that, unlike the embodiment shown in FIGS. 1 to 8, the screw 256, 1256 arranged to mount the fixing block (here, the location screw 1256) must be put in place and tightened into the fixing block before the wall channel 210 is mounted on a wall or other surface so as to allow access to the head of the screw 1256.

In use, the wall channel 210 is secured to a wall 104 or other surface. The skilled person will appreciate that any attachment means known in the art may be used. The location screw 1256 can therefore be thought of as a wall fixing member, as it fixes the fixing block 1252 to the wall channel 210, and thereby to the wall 104 or other surface.

In the embodiment being described, the adjustment channel 1220 is shaped to have two walls 1223 extending parallel to the walls of the second U-shaped portion 1220*b*, and outside thereof. The second U-shaped portion 1220*b* and walls 1233 are sized and spaced to engagingly receive a profile strip (not shown). The profile strip thereby covers the head 1254*a* of the adjustment screw 1254, shielding it from view and from water. The profile strip may have any of the properties as for the profile strip 300 pictured in FIG. 3.

What is claimed is:

1. An adjustable mounting assembly comprising:

a wall channel arranged to be fixedly connected to a wall, the wall channel having a base;

an adjustment channel arranged to fit at least partially within the wall channel; and a connection means arranged to connect the wall channel to the wall and to adjustably connect the adjustment channel to the wall channel such that the adjustment channel can be moved towards and away from the base of the wall channel, wherein the connection means comprises:

a fixing block arranged to fit within the wall channel and between the wall channel and the adjustment channel, the fixing block having a first aperture therethrough, wherein the first aperture is arranged to receive a wall fixing member, the wall fixing member being arranged to pass through the base of the wall channel so as to secure the fixing block to the wall channel and the wall channel to the wall; and an adjustable fixing member arranged to pass through the adjustment channel and into the fixing block, so as to secure the adjustment channel to the fixing block, a head of the adjustable fixing member being within the adjustment channel when in use;

wherein movement of the adjustable fixing member is arranged to provide the movement of the adjustment channel towards and away from the base of the wall channel, and the adjustment channel is arranged to receive a profile strip to cover the wall fixing member and the adjustable fixing member, and wherein the adjustment channel has a first aperture wherein:

in a first position, the wall fixing member is aligned to be received in the first aperture; and in a second position, the wall fixing member is disposed through the adjustment channel.

2. The adjustable mounting assembly of claim 1, wherein the adjustable fixing member comprises a screw and the movement of the adjustable fixing member is rotation of the screw.

3. The adjustable mounting assembly of claim 1, wherein the adjustable fixing member is arranged to be oriented at least substantially perpendicular to the length of the adjustment channel when in use.

4. The adjustable mounting assembly of claim 1, wherein the adjustable fixing member comprises a biasing member arranged to exert a force on the adjustment channel to hold the adjustment channel against a head of the adjustable fixing member.

5. The adjustable mounting assembly of claim 4, wherein the adjustable fixing member comprises a screw and the movement of the adjustable fixing member is rotation of the screw, and wherein the biasing member is an adjustment spring arranged around a shaft of the adjustable fixing member.

6. The adjustable mounting assembly of claim 1, further comprising the profile strip, and wherein the profile strip is at least one of push-fit and magnetic.

7. The adjustable mounting assembly of claim 1, wherein the fixing block has a second aperture spaced from the first aperture, and wherein the second aperture is arranged to receive the adjustable fixing member.

8. The adjustable mounting assembly of claim 7, wherein second aperture is blind.

9. The adjustable mounting assembly of claim 7, wherein the adjustable fixing member comprises a biasing member arranged to exert a force on the adjustment channel to hold the adjustment channel against a head of the adjustable fixing member, and wherein the second aperture is wider nearest an opening of the second aperture so as to accommodate the biasing member in the region of the opening of the second aperture.

10. The adjustable mounting assembly of claim 7, wherein the second aperture is sized such that at least the majority of the length of the adjustable fixing member can be accommodated within the second aperture.

11. The adjustable mounting assembly of claim 1, wherein the fixing block is substantially L-shaped in cross-section.

12. The adjustable mounting assembly of claim 11, wherein the wall fixing member is a wall screw and the first aperture of the adjustment channel is wide enough for a head of the wall screw to pass therethrough.

13. The adjustable mounting assembly of claim 1, wherein the adjustment channel has a second aperture arranged to allow a shaft of the adjustable fixing member to be inserted therethrough, the second aperture of the adjustment channel being too narrow for a head of the adjustable fixing member to pass therethrough.

14. The adjustable mounting assembly of claim 13, wherein the adjustment channel comprises a closed channel parallel to an open channel, and wherein the second aperture of the adjustment channel is through the wall of the closed channel furthest from the open channel.

15. The adjustable mounting assembly of claim 14, wherein the adjustment channel comprises a third aperture, the third aperture being through the wall of the closed channel which forms the base of the open channel and aligned with the second aperture, and wherein the third aperture is wide enough for a head of the adjustable fixing member to pass therethrough and suitable for allowing the adjustable fixing member to be adjusted therethrough.

16. The adjustable mounting assembly of claim 14, wherein the adjustment channel is shaped such that a head of the adjustable fixing member is retained within the closed channel in use.

17. The adjustable mounting assembly of claim 14, wherein the open channel is arranged to receive the profile strip in use.

18. A kit of parts for an adjustable mounting assembly, the kit of parts comprising:

a wall channel arranged to be fixedly connected to a wall, the wall channel having a base;

an adjustment channel arranged to fit at least partially within the wall channel; and a connection means arranged to connect the wall channel to the wall and to adjustably connect the adjustment channel to the wall channel such that the adjustment channel can be moved towards and away from the base of the wall channel, wherein the connection means comprises:

a fixing block arranged to fit within the wall channel and between the wall channel and the adjustment channel;

a wall fixing member arranged to pass through the base of the wall channel so as to secure the fixing block to the wall channel and the wall channel to the wall; and an adjustable fixing member arranged to pass through the adjustment channel and into the fixing block, so as to secure the adjustment channel to the fixing block, a head of the adjustable fixing member being within the adjustment channel when in use;

wherein movement of the adjustable fixing member is arranged to provide the movement of the adjustment channel towards and away from the base of the wall channel, and the adjustment channel is arranged to receive a profile strip to cover the wall fixing member and the adjustable fixing member, and wherein the adjustment channel has a first aperture, wherein: in a first position, the wall fixing member configured to be aligned and to be received in the first aperture; and in a second position, the wall fixing member is configured to be received in the first aperture.

19. The kit of parts of claim 18, wherein the wall fixing member is arranged to be at least substantially perpendicular to the length of the wall channel in use.

20. A shower cubicle comprising an adjustable mounting assembly, wherein the adjustable mounting assembly of the shower cubicle comprises:

a wall channel arranged to be fixedly connected to a wall, the wall channel having a base;

an adjustment channel arranged to fit at least partially within the wall channel; and a connection means arranged to connect the wall channel to the wall and to adjustably connect the adjustment channel to the wall channel such that the adjustment channel can be moved towards and away from the base of the wall channel, wherein the connection means comprises:

a fixing block arranged to fit within the wall channel and between the wall channel and the adjustment channel, the fixing block having a first aperture therethrough, wherein the first aperture is arranged to receive a wall fixing member, the wall fixing member being arranged to pass through the base of the wall channel so as to secure the fixing block to the wall channel and the wall channel to the wall; and an adjustable fixing member arranged to pass through the adjustment channel and into the fixing block, so as to secure the adjustment channel to the fixing block, a head of the adjustable fixing member being within the adjustment channel when in use;

wherein movement of the adjustable fixing member is arranged to provide the movement of the adjustment channel towards and away from the base of the wall channel, and the adjustment channel is arranged to receive a profile strip to cover the wall fixing member and the adjustable fixing member, and wherein the adjustment channel has a first aperture, wherein: in a first position, the wall fixing member is aligned to be received in the first aperture; and in a second position, the wall fixing member is received in the first aperture.

* * * * *